US011814840B2

(12) United States Patent
Frame et al.

(10) Patent No.: US 11,814,840 B2
(45) Date of Patent: Nov. 14, 2023

(54) CEILING GRID STRUCTURAL MEMBER AND CEILING GRID ASSEMBLY

(71) Applicant: POLARGY, INC., Sunnyvale, CA (US)

(72) Inventors: Cary Frame, Longmont, CO (US); Ethan Koval, San Jose, CA (US)

(73) Assignee: POLARGY, INC., Sunnyvale, CA (US)

( * ) Notice: Subject to any disclaimer, the term of this patent is extended or adjusted under 35 U.S.C. 154(b) by 27 days.

(21) Appl. No.: 17/721,029

(22) Filed: Apr. 14, 2022

(65) Prior Publication Data

US 2023/0332403 A1 Oct. 19, 2023

(51) Int. Cl.

| | |
|---|---|
| ***E04B 9/06*** | (2006.01) |
| ***E04B 9/10*** | (2006.01) |
| ***E04B 9/20*** | (2006.01) |
| ***E04B 9/14*** | (2006.01) |
| *E04B 9/00* | (2006.01) |
| *E04B 9/24* | (2006.01) |

(52) U.S. Cl.

CPC ..... *E04B 9/064* (2013.01); *E04B 9/10* (2013.01); *E04B 9/14* (2013.01); *E04B 9/20* (2013.01); *E04B 9/006* (2013.01); *E04B 9/241* (2013.01)

(58) Field of Classification Search

CPC . E04B 9/006; E04B 9/064; E04B 9/10; E04B 9/14; E04B 9/20; E04B 9/241

USPC ..... 52/656.9, 506.05, 506.06, 220.6, 506.07

See application file for complete search history.

(56) References Cited

U.S. PATENT DOCUMENTS

| | | | | |
|---|---|---|---|---|
| 3,898,782 A * | 8/1975 | Donato | E04B 9/064 | 403/217 |
| 3,968,624 A * | 7/1976 | Allmendinger | F16B 5/02 | 403/388 |
| 4,784,552 A * | 11/1988 | Rebentisch | F16B 37/046 | 403/348 |
| 4,830,531 A * | 5/1989 | Condit | F16B 37/045 | 403/348 |
| 5,313,759 A * | 5/1994 | Chase, III | E04B 9/18 | 52/39 |
| 6,029,413 A * | 2/2000 | Compas, Jr. | E04B 9/127 | 52/506.07 |
| 6,158,186 A * | 12/2000 | Feller | E04B 9/14 | 52/506.07 |
| 6,779,315 B1 * | 8/2004 | Bongio | E04B 9/064 | 52/506.07 |

(Continued)

FOREIGN PATENT DOCUMENTS

| | | | |
|---|---|---|---|
| EP | 3 708 732 A1 | 9/2020 | |
| WO | WO-2016081019 A1 * | 5/2016 | E04B 9/006 |

OTHER PUBLICATIONS

Daxten, Structural Suspended Ceiling brochure, at least as earlier as Mar. 24, 2016, pp. 1-1, URL: https://www.daxten.com/uk/structural-suspended-ceiling.html.

(Continued)

*Primary Examiner* — James M Ference

(74) *Attorney, Agent, or Firm* — Crowell & Moring LLP

(57) ABSTRACT

A ceiling grid strut is provided that includes a rail and a strut channel that is integral to the rail. A ceiling grid assembly is provided that includes a first ceiling grid strut, a second ceiling grid strut, a first threaded fastener, a second threaded fastener, and a connector.

20 Claims, 12 Drawing Sheets

(56) References Cited

U.S. PATENT DOCUMENTS

| | | | | |
|---|---|---|---|---|
| 7,287,733 | B2 * | 10/2007 | Bongio | E04B 9/127 52/506.08 |
| 7,886,496 | B1 * | 2/2011 | Spransy | E04B 9/127 52/506.07 |
| 9,038,344 | B2 * | 5/2015 | Mayer | F21V 33/006 52/39 |
| 9,166,390 | B2 * | 10/2015 | Dean | H02G 3/0456 |
| D795,454 | S * | 8/2017 | Curtin | D25/119 |
| 9,771,718 | B1 * | 9/2017 | Curtin | E04C 3/07 |
| D828,581 | S * | 9/2018 | Reynolds | D25/61 |
| 10,288,269 | B2 * | 5/2019 | Sareyka | E04B 9/18 |
| 10,590,649 | B1 * | 3/2020 | Morrison | E04B 9/20 |
| D901,038 | S * | 11/2020 | Kennedy | D25/61 |
| 11,384,538 | B1 * | 7/2022 | Kennedy | E04B 9/20 |
| 11,459,753 | B2 * | 10/2022 | McGee | E04H 5/08 |
| 2003/0213199 | A1 * | 11/2003 | Bongio | E04B 9/183 52/506.07 |
| 2009/0255203 | A1 * | 10/2009 | Richardson | H02G 3/281 362/382 |
| 2010/0252704 | A1 * | 10/2010 | Kunishita | E04B 9/183 248/223.41 |
| 2012/0240495 | A1 * | 9/2012 | Eychaner | E04B 9/20 52/506.07 |
| 2013/0047541 | A1 * | 2/2013 | Mayer | E04B 9/366 52/506.05 |
| 2013/0308303 | A1 * | 11/2013 | Greenholt | F21S 8/063 362/150 |
| 2015/0233116 | A1 * | 8/2015 | Mayer | E04B 9/04 52/506.05 |
| 2017/0130455 | A1 * | 5/2017 | Bergman | E04B 9/245 |
| 2017/0130456 | A1 * | 5/2017 | Bergman | E04B 9/04 |
| 2017/0292269 | A1 * | 10/2017 | Tornqvist | E04B 9/064 |
| 2018/0100305 | A1 | 4/2018 | Curtin et al. | |
| 2019/0203466 | A1 * | 7/2019 | Mayer | E04B 9/366 |
| 2021/0032864 | A1 * | 2/2021 | Mayer | E04B 9/245 |
| 2022/0195728 | A1 * | 6/2022 | Kennedy | E04B 9/26 |

OTHER PUBLICATIONS

Gordon Incorporated, Data Center Ceilings, Imperial, dated at least as early as Oct. 2018, pp. 1-20, Gordon Incorporated, Bossier City, LA, Brochure DG010IMP 10.18.

Gordon Incorporated, Data Center Ceilings Structural Grid—DG 1.5 Main/Cross Tee, at least as early as Jan. 1, 2022, pp. 1-19, Gordon Architectural + Engineered Solutions, Gordon-Inc.com, Gordon Incorporated, Bossier City, LA.

Gordon Incorporated, Data Center Ceilings Structural Grid—DG 3.0 Main/Cross Tee, at least as early as Jan. 1, 2022, pp. 1-19, Gordon Architectural + Engineered Solutions, Gordon-Inc.com, Gordon Incorporated, Bossier City, LA.

Gordon Incorporated, Data Center Ceilings Structural Grid—DG X-Span Main/Cross Tee, at least as early as Jan. 1, 2022, pp. 1-20, Gordon Architectural + Engineered Solutions, Gordon-Inc.com, Gordon Incorporated, Bossier City. LA.

Team Technologies: Weekly Photo Review: Week 10 (Data Room Mock-Up); Madison Data Center Construction, dated Jun. 14, 2011, pp. 1-5, URL: http:/blog.team-companies.com/2011/06/weekly-photo-review-week-10-data-room.html.

Unistrut Metal Framing, General Engineering Catalog, dated 1999, pp. 1-256, North American Edition No. 12, Unistrut Corporation, Itasca, IL.

Unistrut Nuclear Power Engineering Catalog NE-3, dated Jun. 2001, pp. 1-44, Unistrut Corooration. Harvev. IL.

* cited by examiner

CEILING GRID STRUCTURAL MEMBER AND CEILING GRID ASSEMBLY

TECHNICAL FIELD

This application relates to ceilings and, in particular, to drop ceilings.

BACKGROUND

Present drop ceilings suffer from a variety of drawbacks, limitations, and disadvantages. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
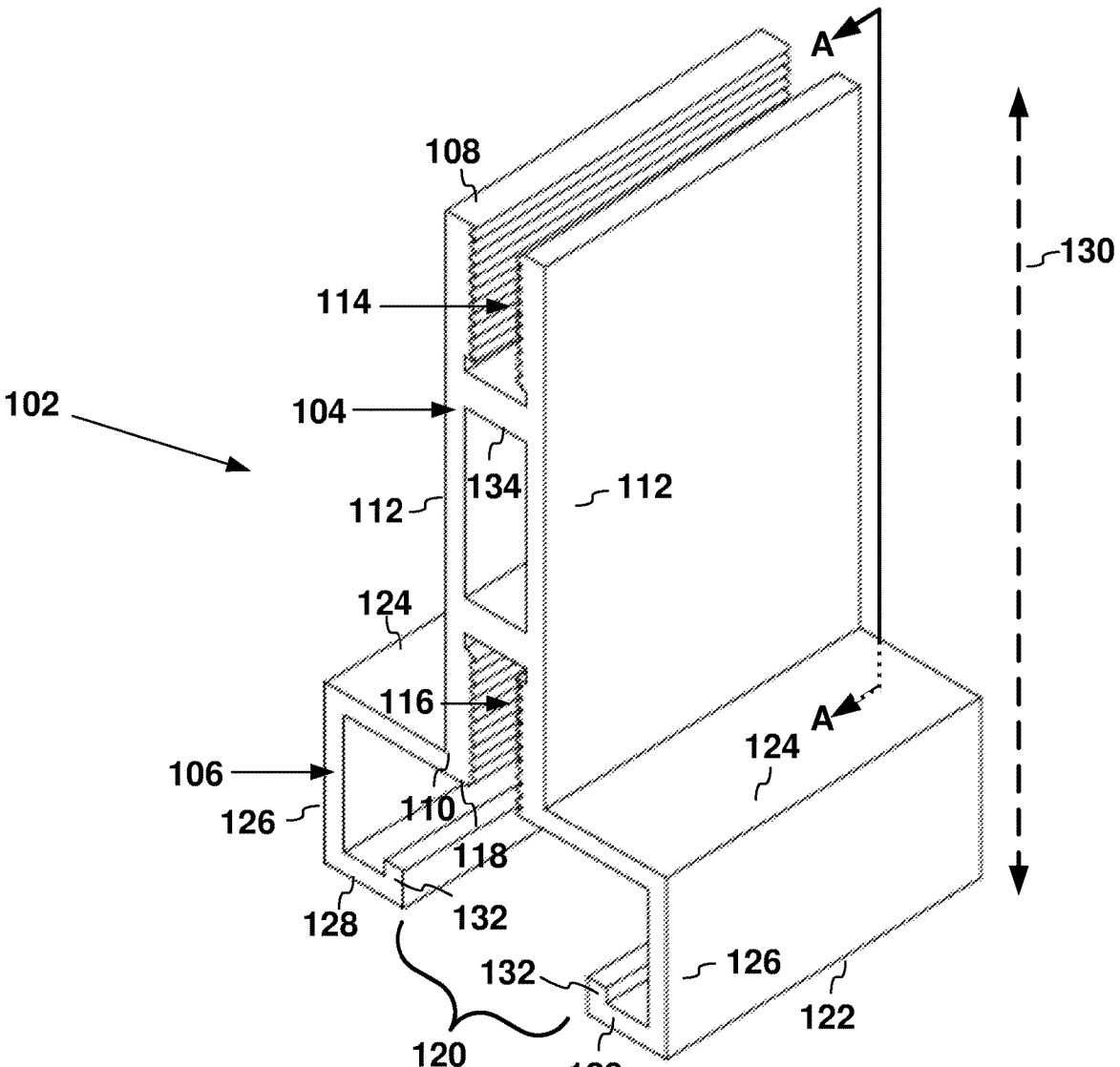
FIG. 1 is a perspective view of an example of a ceiling grid strut.

In one example, a ceiling grid strut is provided that includes a rail and a strut channel that is integral to the rail. The rail includes a top, a bottom, and two sides, wherein the two sides are wider than the top and the bottom, wherein the top includes an upper slot, and the bottom includes a lower slot, and wherein the upper slot, the lower slot, or both is/are threaded. A top of the strut channel extends along the bottom of the rail. The lower slot in the bottom of the rail opens into the top of the strut channel. A channel opening extends along a bottom of the strut channel. The strut channel includes two panel shelves, two sidewalls, and two inner ledges. The panel shelves are located at the top of the strut channel. Each of the panel shelves extends outwards from a respective one of the two sides of the rail and substantially perpendicular to a vertical axis of the rail. An upper surface of each of the panel shelves is configured to support an edge of a respective ceiling panel, wherein the sidewalls of the strut channel extend from the panel shelves and away from the bottom of the rail. The inner ledges are located at the bottom of the strut channel and define the channel opening.

In a second example, a ceiling grid assembly is provided that includes a first ceiling grid strut, a second ceiling grid strut, a first threaded fastener, a second threaded fastener, and a connector. The connector includes a first projection and a second projection. Each of the first and second projections has a respective hole. The first projection is coupled to the first ceiling grid strut by the first threaded fastener, which passes through the hole of the first projection of the connector and is threaded into the upper slot of the rail or the lower slot of the rail of the first ceiling grid strut. The second projection is coupled to the second ceiling grid strut by the second threaded fastener, which passes through the hole of the second projection of the connector and is threaded into the upper slot of the rail or the lower slot of the rail of the second ceiling grid strut.

One technical advantage of the strut and grid assemblies described below may be that in some examples, nothing protrudes below the bottom surface of the ceiling grid strut enabling other hardware to interface up to the bottom of the ceiling grid strut unobstructed. Another technical advantage of the strut and grid assemblies described below may be that hanging loads may be attached to the strut channel instead of into threaded slot(s) of the rail. This enables universal strut connectivity rather than having multiple versions of the strut based on an all-thread rod size to be attached to the strut and/or grid assembly. Another technical advantage may be to avoid compromising the threaded slot(s) of the rail due to dynamic rearrangements of the hanging loads or during reconfiguration of the loads. Another technical advantage of the strut and grid assemblies described below is that the panel shelves are built into the ceiling grid strut.

FIG. 1 is a perspective view of an example of a ceiling grid strut 102 (also referred to herein as simply the "strut"). In FIG. 1, the strut 102 appears shorter in the longitudinal direction than in the vertical direction. However, in a typical example, the strut 102 is longer in the longitudinal direction than in the vertical direction.

The ceiling grid strut 102 includes a rail 104 and a strut channel 106. The strut channel 106 is integral to the rail 104. In other words, the strut channel 106 and the rail 104 are formed as a single piece instead of two parts coupled, bonded, and/or welded together. For example, the ceiling grid strut 102 may be an extrusion formed by extruding a material such as aluminum through an extrusion die. The ceiling grid strut 102 may be made of any suitable material such as metal, metal alloy, or fiber-reinforced plastic (FRP).

In the example illustrated in FIG. 1, the rail 104 includes a top 108, a bottom 110, and two sides 112. The two sides 112 are wider than the top 108 and the bottom 110. The top 108 includes an upper slot 114, and the bottom 110 includes a lower slot 116. The upper slot 114 and the lower slot 116 are threaded. In other examples, only the upper slot 114 or only the lower slot 116 is threaded.

A top 118 of the strut channel 106 extends along the bottom 110 of the rail 104. The lower slot 116 in the bottom 110 of the rail 104 opens into the top 118 of the strut channel 106. A channel opening 120 extends along a bottom 122 of the strut channel 106.

The strut channel 106 comprises two panel shelves 124, two sidewalls 126, and two inner ledges 128. The panel shelves 124 are located at the top 118 of the strut channel 106. Each of the panel shelves 124 extends outwards from a respective one of the two sides 112 of the rail 104 and substantially perpendicular to a vertical axis 130 of the rail 104. The sidewalls 126 of the strut channel 106 extend downward from the panel shelves 124 and away from the bottom 110 of the rail 104. The inner ledges 128 are located at the bottom 122 of the strut channel 106 and define the channel opening 120.

Figure 3:
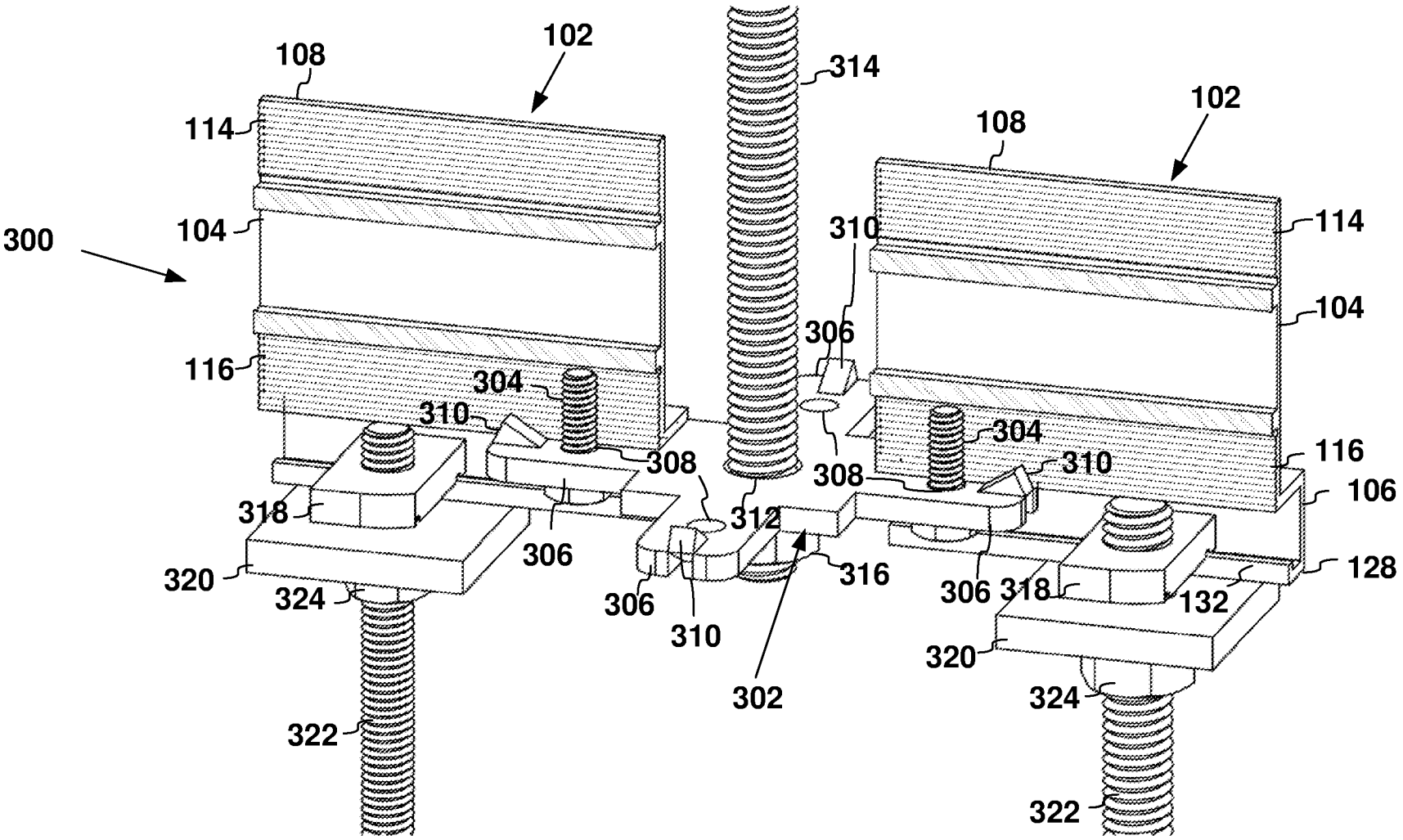
FIG. 3 is a perspective view of an example of a ceiling grid assembly for supporting a secondary ceiling.

In the example shown in FIG. 1, each of the inner ledges 128 of the strut channel 106 includes a raised edge 132 forming a hook configured to receive a strut nut (not shown) having a respective groove (not shown) that receives the raised edge 132 of the respective inner ledge 128 (the strut nut and the respective nut are shown in FIG. 3). In other examples, the inner ledges 128 of the strut channel 106 may not include the raised edge 132.

The rail 104 shown in FIG. 1 further includes a box arch 134 located between the upper slot 114 and the lower slot 116. Alternative examples may include any structure or combination of structures between the upper slot 114 and the lower slot 116. For example, there may only be solid material between the upper slot 114 and the lower slot 116.

Figure 2:
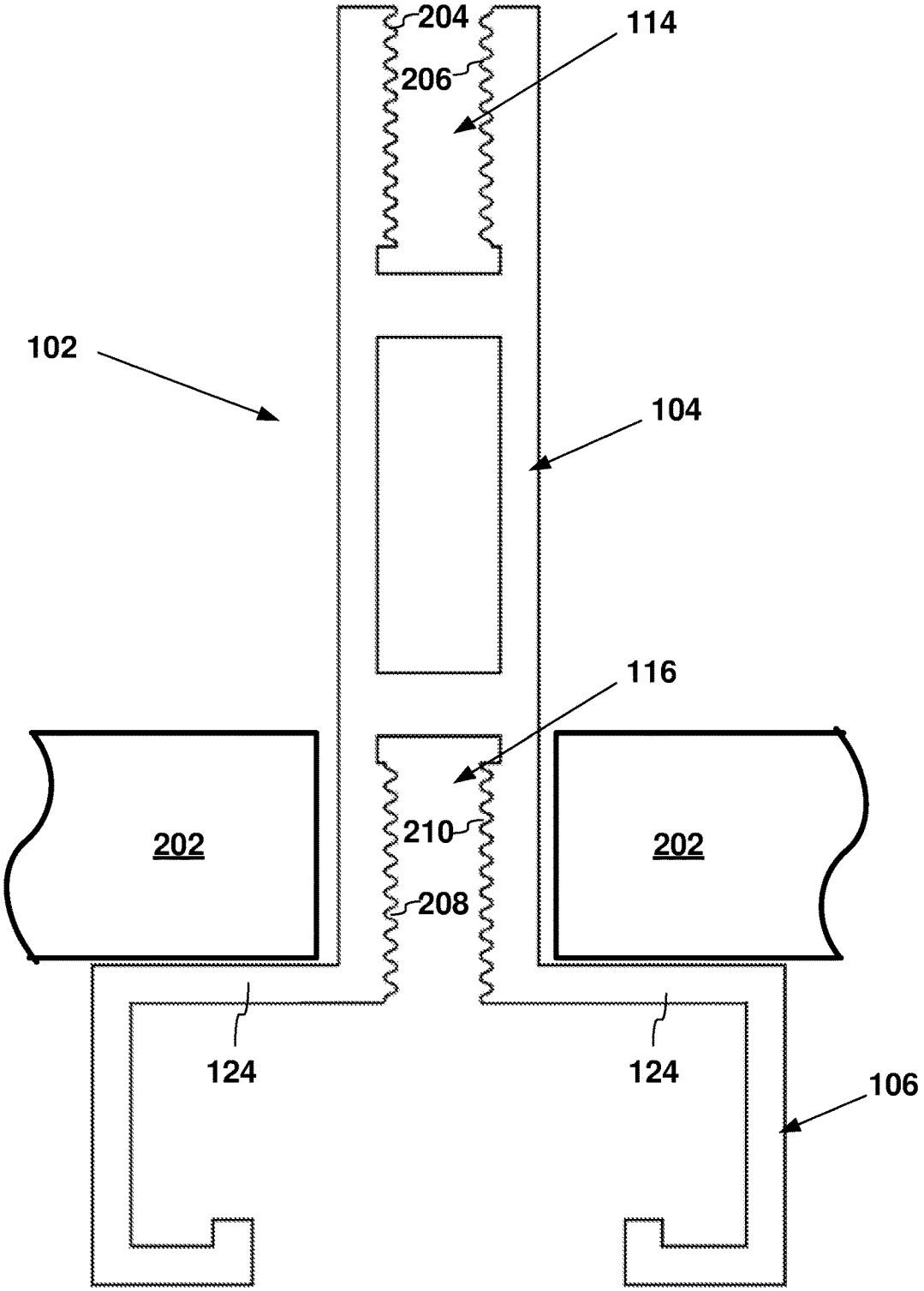
FIG. 2 is a cross-sectional view of the strut shown in FIG. 1.

FIG. 2 is a cross-sectional view of the strut 102 shown in FIG. 1 and also illustrates a cross-section of edges of two ceiling panels 202. As shown in FIG. 2, an upper surface of each of the panel shelves 124 is configured to support an edge of a respective ceiling panel 202.

The rail 104 may have a substantially rectangular cross-section as shown in FIG. 2. In alternative examples, the rail 104 may have a different shape and/or include additional features that change the cross-sectional shape of the rail 104.

Where the lower slot 116 is a threaded slot, the threaded slot includes a first set of grooves 208 on a first side of the lower slot 116 and a second set of grooves 210 on a second side of the lower slot 116. The second set of grooves 206 are vertically offset from the first set of grooves 204 so that the threaded slot may receive a threaded fastener (for example, the threaded fastener is shown in FIG. 3).

Figure 7:
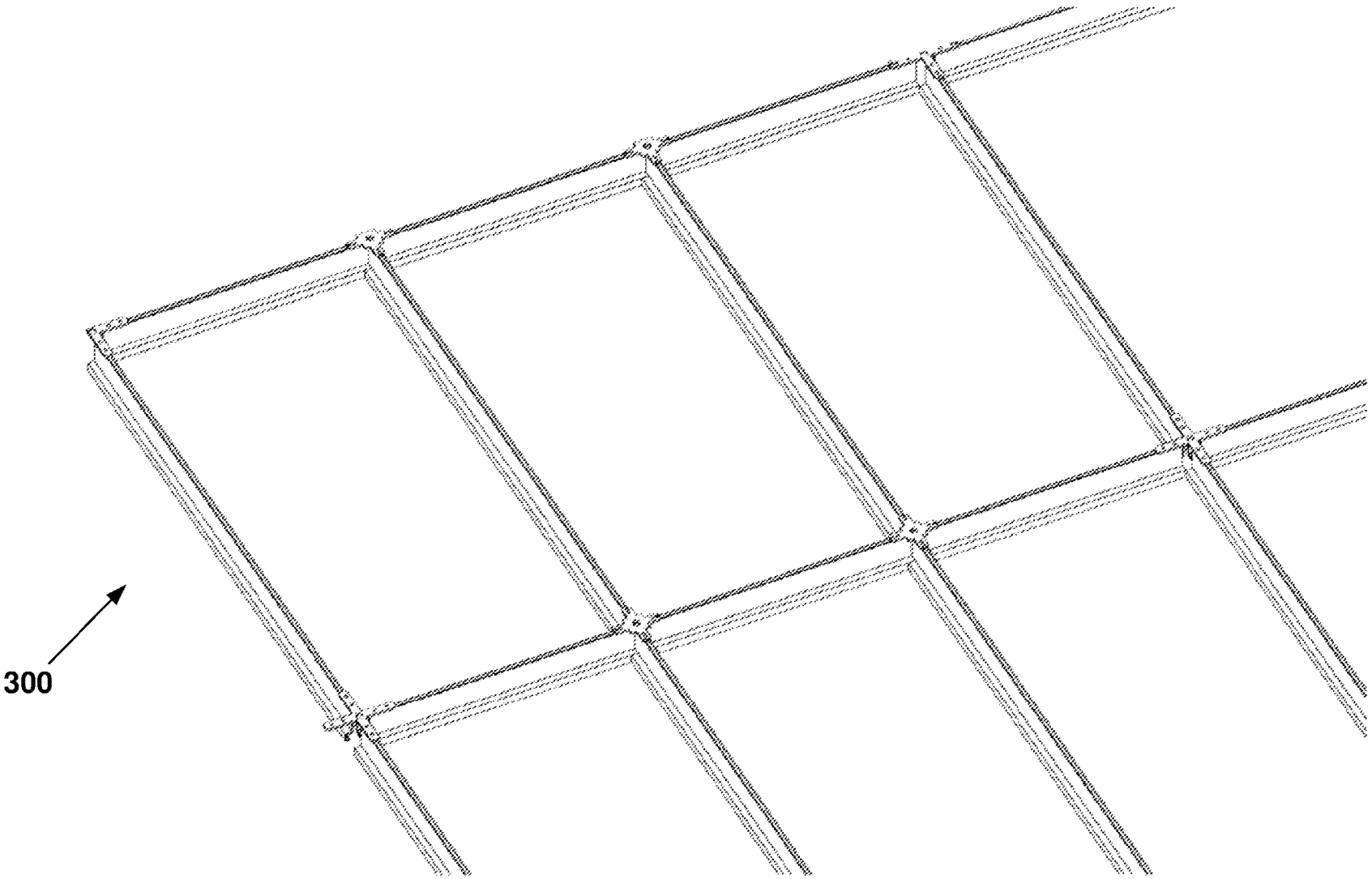
FIG. 7 illustrates an example of the ceiling grid assembly forming a grid with the struts, where the connectors are coupled to the top of the rail of the struts.

Similarly, where the upper slot 114 is a threaded slot, the threaded slot includes a first set of grooves 204 on a first side of the upper slot 114 and a second set of grooves 206 on a second side of the upper slot 114. The second set of grooves 206 are vertically offset from the first set of grooves 204 so that the threaded slot may receive the threaded fastener (for example, the threaded fastener is shown in FIG. 7).

In some examples, the strut 102 many not include the upper slot 114. In alternative examples, the strut 102 may not include the lower slot 116.

FIG. 3 is a perspective view of an example of a ceiling grid assembly 300 for supporting a secondary ceiling. The ceiling grid assembly 300 includes a first ceiling grid strut (shown at the left) and a second ceiling grid strut (shown at the right), where each of the first ceiling grid strut and the second ceiling grid strut is the same as the ceiling grid strut 102 shown in FIG. 1. In order to show the interior of the ceiling grid struts 102, the ceiling grid struts 102 are shown in FIG. 3 as a cutaway along plane A-A indicated in FIG. 1.

The illustrated example of the ceiling grid assembly also includes a connector 302, a first threaded fastener 304, and a second threaded fastener 304. The ceiling grid struts 102 are coupled together by the connector 302 using the threaded fasteners 304.

The threaded fasteners 304 may be any fastener that has threads. Examples of the threaded fasteners include screws, bolts, and threaded rods.

The connector 302 includes at least a first projection 306 and a second projection 306. Each of the first and second projections 306 has a respective hole 308. The first projection 306 is coupled to the first ceiling grid strut 102 by the first threaded fastener 304, which passes through the hole 308 of the first projection 306 of the connector and is threaded into the lower slot 116 of the rail 104 of the first ceiling grid strut 102. Similarly, the second projection 306 is coupled to the second ceiling grid strut 102 by the second threaded fastener 304, which passes through the hole 308 of the second projection 306 of the connector 302 and is threaded into the lower slot 116 of the rail 104 of the second ceiling grid strut 102.

In some examples, the projections 306 include tabs 310. The tabs 310 may be slidably engaged in the lower slot 116 of the rail 104. The tabs 310 may be located at distal ends of the projections 306, such as in the example shown in FIG. 3. In other examples, the tabs 310 may be in a different location.

Figure 5:
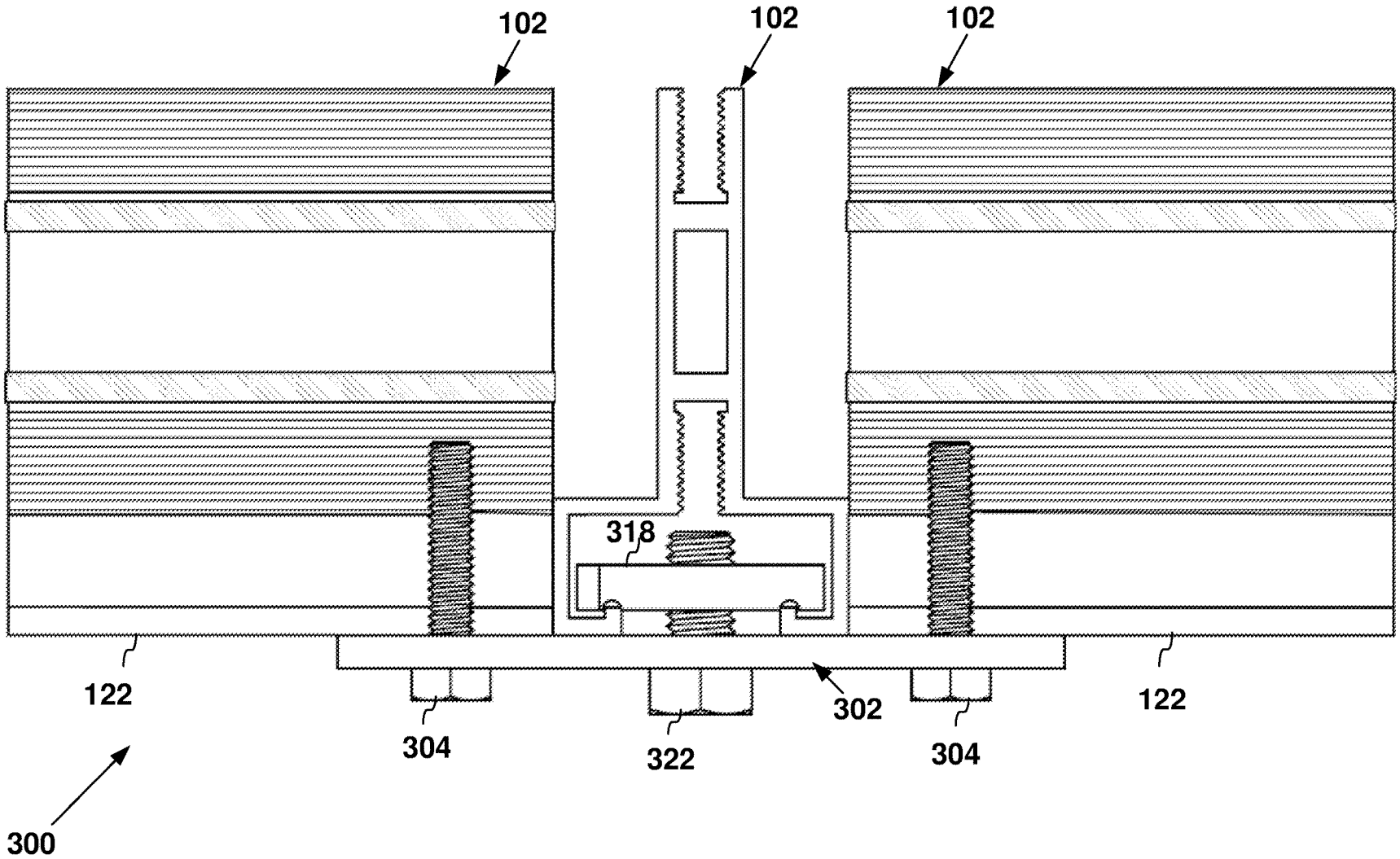
FIG. 5 illustrates an example of the ceiling grid assembly in which the connector couples three struts together.

In the illustrated example, each of the first and second projections 306 of the connector 302 is inserted into the respective one of the first and second strut channels 106. In alternative examples, the projections 306 (and the connector 302) are located outside of the strut channels 106 and are fastened to the bottom 122 of the strut channels 106 (such an example is shown in FIG. 5).

Alternatively or in addition, the connector 302 may be coupled to the top 108 of the rail 104 of the struts 102 (such an example is shown in FIG. 7). In such examples, the first projection 306 of the connector 302 is coupled to the first ceiling grid strut 102 by the first threaded fastener 304, which passes through the hole 308 of the first projection 306 of the connector 302 and is threaded into the upper slot 114 of the rail 104 of the first ceiling grid strut 102. Similarly, the second projection 306 is coupled to the second ceiling grid strut 102 by the second threaded fastener 304, which passes through the hole 308 of the second projection 306 of the connector 302 and is threaded into the upper slot 114 of the rail 104 of the second ceiling grid strut 102. In some of such examples, the projections 306 of the connector 302 may have tabs 310 that are slidably engaged in the upper slot 114 of the struts 102.

The connector 302 may have a hole 312 configured to receive a rod 314 that is attached to a primary ceiling (not shown). The hole 312 may be centrally located on the connector 302 as shown. More generally, the hole 312 may located on the connector 302 so that the hole 312 is located between the struts 102 when the connector 302 is coupled to the struts 102. A nut 316 may be screwed onto the bottom of the rod 314 below the connector 302 so as to support the ceiling grid assembly 300 by holding the connector 302 in place vertically.

The strut channel 106 of the strut 102 may support any type of load. Examples of the load include hot or cold aisle containment, power and cables, fiber cable, cable trays, or any other type of load. For example, as shown in FIG. 5, the strut channel 106 may even support the struts 102 on arranged perpendicular to the strut 102 that is in the center of the figure.

The ceiling grid assembly 300 may include additional hardware for supporting a load with the strut channel 106. For example, the ceiling grid assembly 300 may include a strut nut 318, a strut washer 320, and a threaded fastener 322 used to support a load. The example shown in FIG. 3 shows two sets of strut nuts 318, strut washers 320, and threaded fasteners 322, where each respective set is coupled to a respective one of the struts 102. The ceiling grid assembly may include any number of such sets. The strut nut 318 is in the strut channel 106 and rests on the inner ledges 128 of the strut channel 106 of the ceiling grid strut 102. The strut washer 320 is located outside of the strut channel 106 and is held against the inner ledges 128 of the strut channel 106 by the threaded fastener 322 via a nut 324 located below the strut washer 320. The threaded fastener 322 passes through the strut washer 320, through the channel opening 120, and is threaded into the strut nut 318.

Although the ceiling grid assembly 300 includes the nut 324 under the strut washer 320, any other type of support structure connected to, or part of, the threaded fastener may support the strut washer 320 either alone or in combination with the nut 324.

Figure 4:
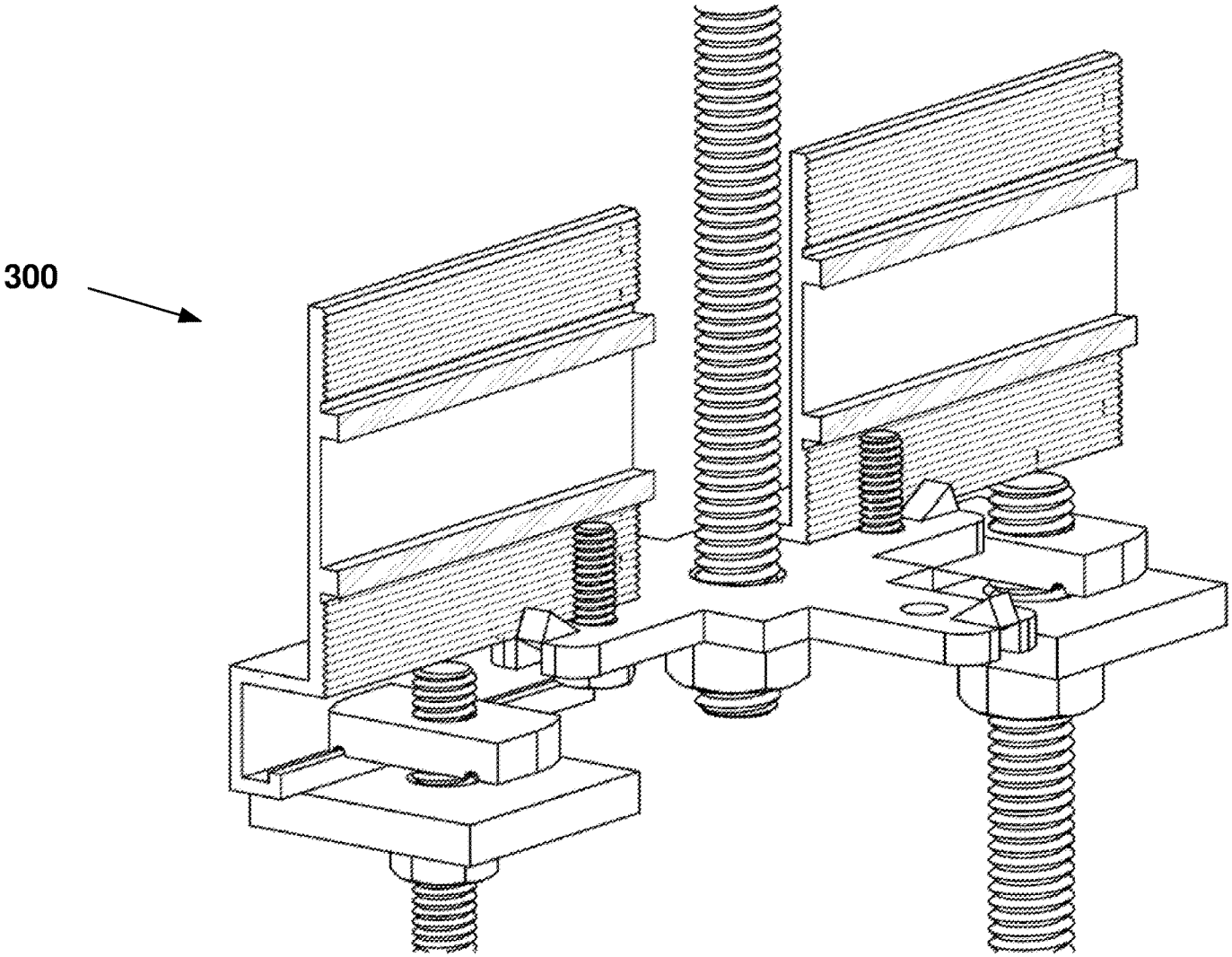
FIG. 4 shows the ceiling grid assembly from a different angle than in FIG. 3.

FIG. 4 shows the ceiling grid assembly 300 from a different angle than in FIG. 3.

FIG. 5 illustrates an example of the ceiling grid assembly 300 in which the connector 302 couples three struts 102 together. In this example, the connector 302 is located outside of the strut channels 106 and is fastened to the bottom 122 of the strut channels 106. Alternatively or in addition, the connector 302 may be coupled to the tops 108 of the struts 102.

Figure 6:
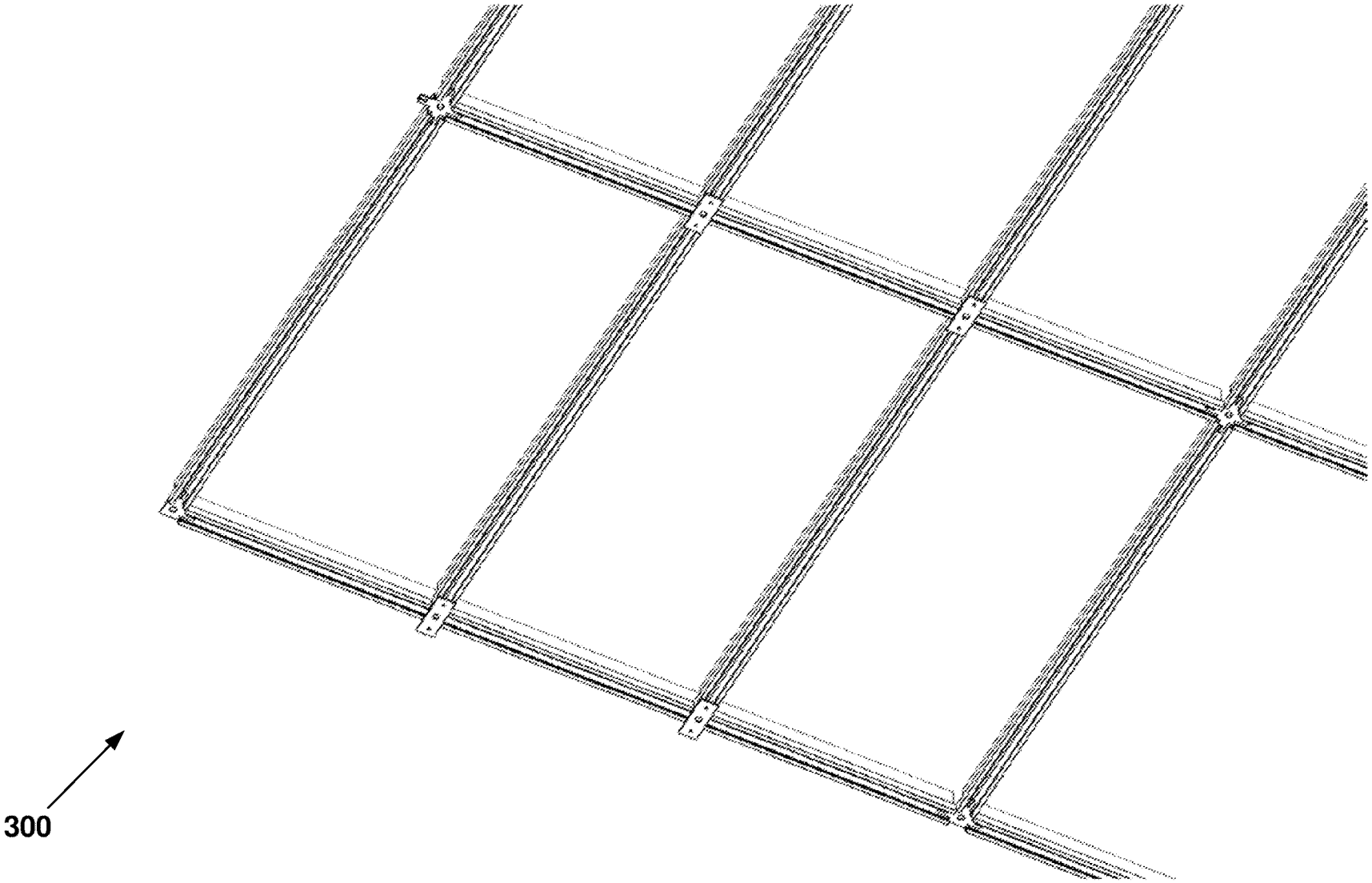
FIG. 6 illustrates an example of the ceiling grid assembly forming a grid with the struts, where the connectors are either at the bottom of the strut channels or inside of the strut channels.

FIG. 6 illustrates an example of the ceiling grid assembly 300 forming a grid with the struts 102, where the connectors 302 are either at the bottom of the strut channels 106 or inside of the strut channels 106. The ceiling grid assembly 300 is configured to hold ceiling panels in each rectangular or square opening of the grid.

FIG. 7 illustrates an example of the ceiling grid assembly 300 forming a grid with the struts 102, where the connectors 302 are coupled to the top 108 of the rail 104 of the struts 102. The ceiling grid assembly 300 is configured to hold ceiling panels in each rectangular or square opening of the grid.

The ends of some of the struts 102 shown in FIG. 7 are notched to receive the strut channel 106 of the strut 102 running perpendicular to the struts 102 that are notched. In other examples, none of the ends of the struts 102 may be notched.

Figure 8A:
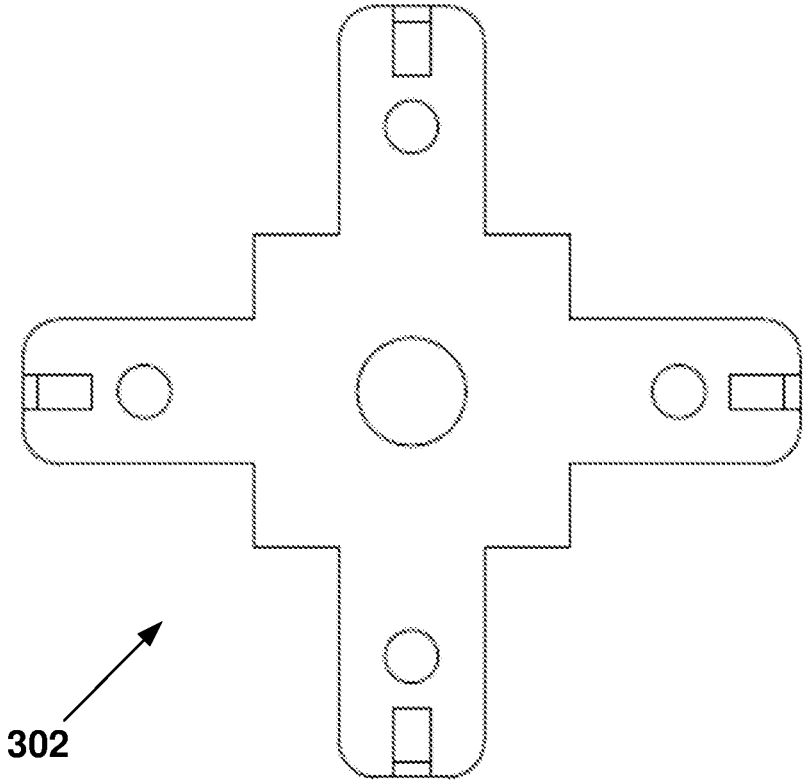
FIG. 8A is a top view of an example of the connector that is a four-way connector.
Figure 8B:
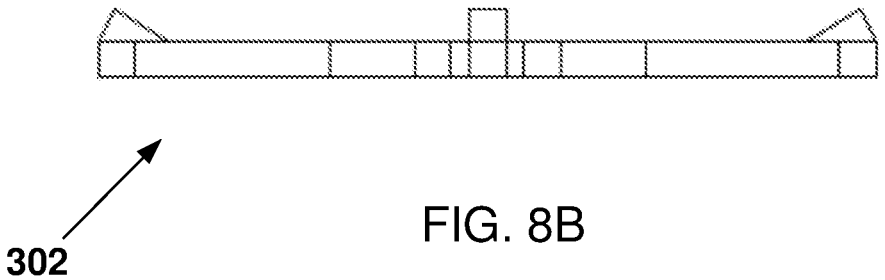
FIG. 8B is a side view of the connector illustrated in FIG. 8A.

FIG. 8A is a top view of an example of the connector 302 that is a four-way connector. FIG. 8B is a side view of the connector 302 illustrated in FIG. 8A. A perspective view of the four-way connector is also shown in FIG. 3. The four-way connector may couple up to four of the struts 102 together.

Figure 9A:
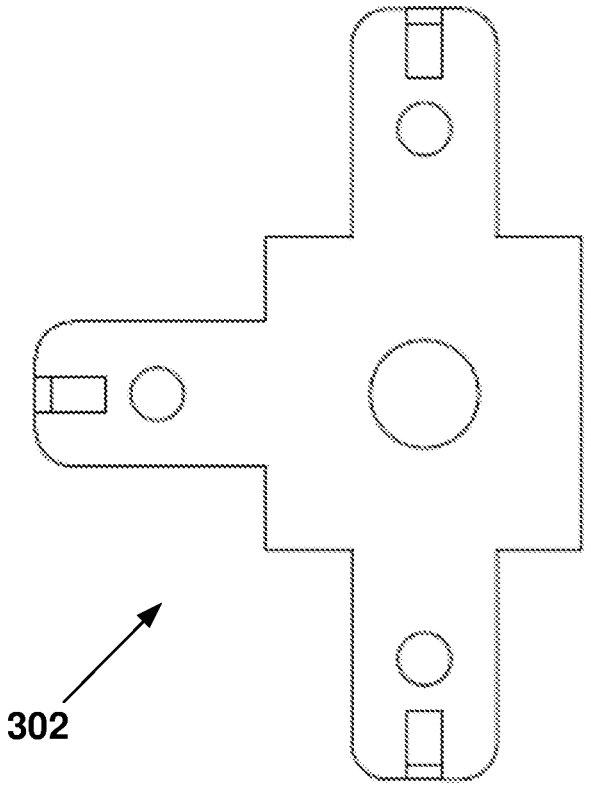
FIG. 9A is a top view of an example of the connector that is a three-way connector.
Figure 9B:
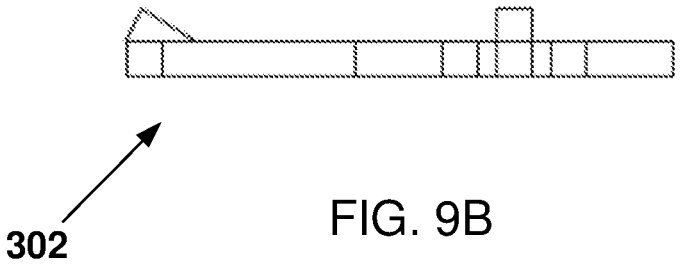
FIG. 9B is a side view of the connector illustrated in FIG. 9A.

FIG. 9A is a top view of an example of the connector 302 that is a three-way connector. FIG. 9B is a side view of the connector 302 illustrated in FIG. 9A. The three-way connector may couple up to three of the struts 102 together. The three-way connector includes three projections 306, where one of the projections 306 is arranged perpendicular to the other two.

Figure 10A:
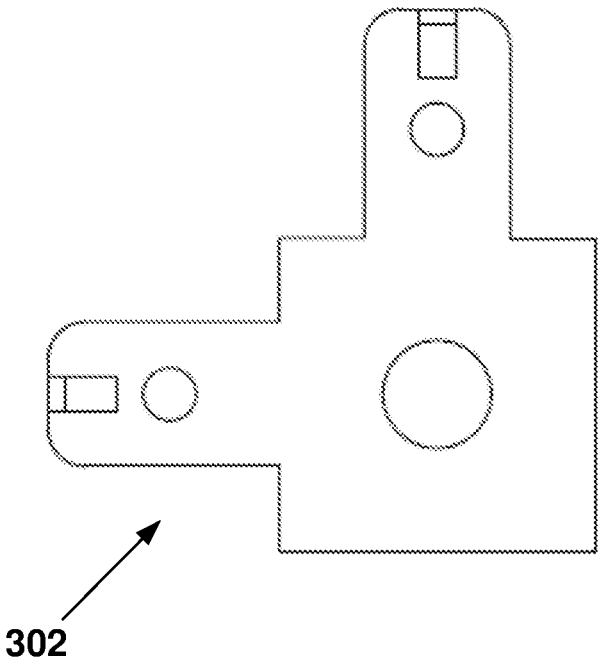
FIG. 10A is a top view of an example of the connector that is a two-way connector.
Figure 10B:
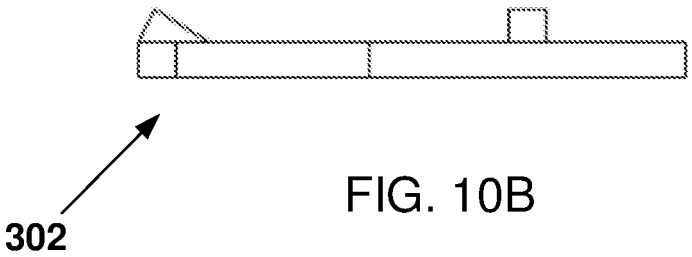
FIG. 10B is a side view of the connector illustrated in FIG. 10A.

FIG. 10A is a top view of an example of the connector 302 that is a two-way connector. FIG. 10B is a side view of the connector 302 illustrated in FIG. 10A. The illustrated example of the two-way connector may couple two struts 102 together at right angles to each other because the first projection 306 of the connector 302 is perpendicular to the second projection 306 of the connector 302.

Figure 11A:
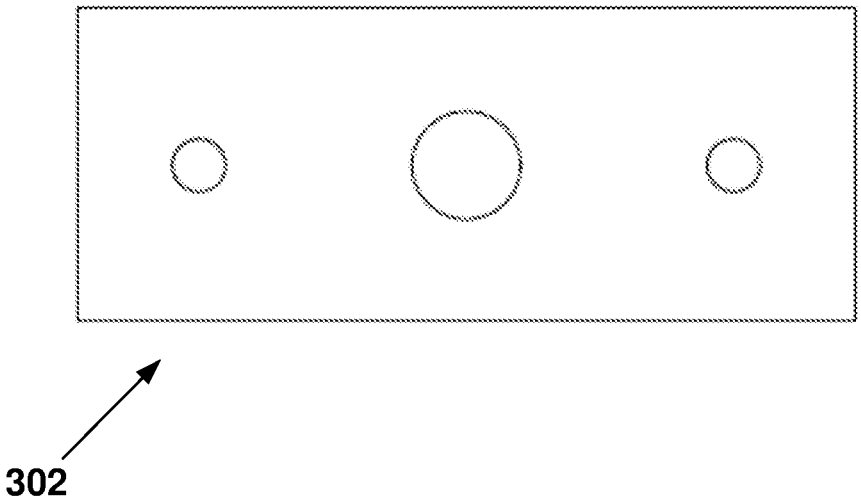
FIG. 11A is a top view of an example of the connector that is a two-way connector.
Figure 11B:
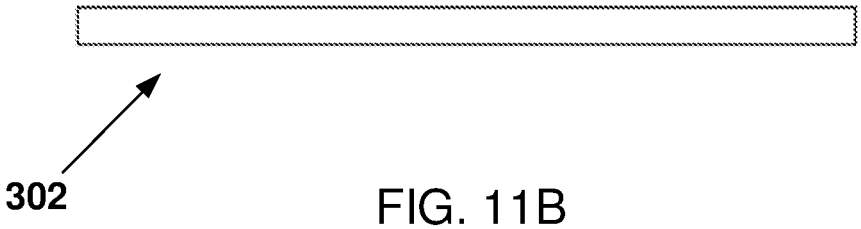
FIG. 11B is a side view of the connector illustrated in FIG. 11A.

FIG. 11A is a top view of an example of the connector 302 that is a two-way connector. FIG. 11B is a side view of the connector 302 illustrated in FIG. 11A. The illustrated example of the two-way connector may couple two of the struts 102 together so each is aligned along one axis. This is because the first and second projections 306 are aligned along one axis. The illustrated example of the 2-way two-way connector may also couple three of the struts 102 together as shown in FIG. 5. One of the three struts 102 is perpendicular to the other two.

Figure 12A:
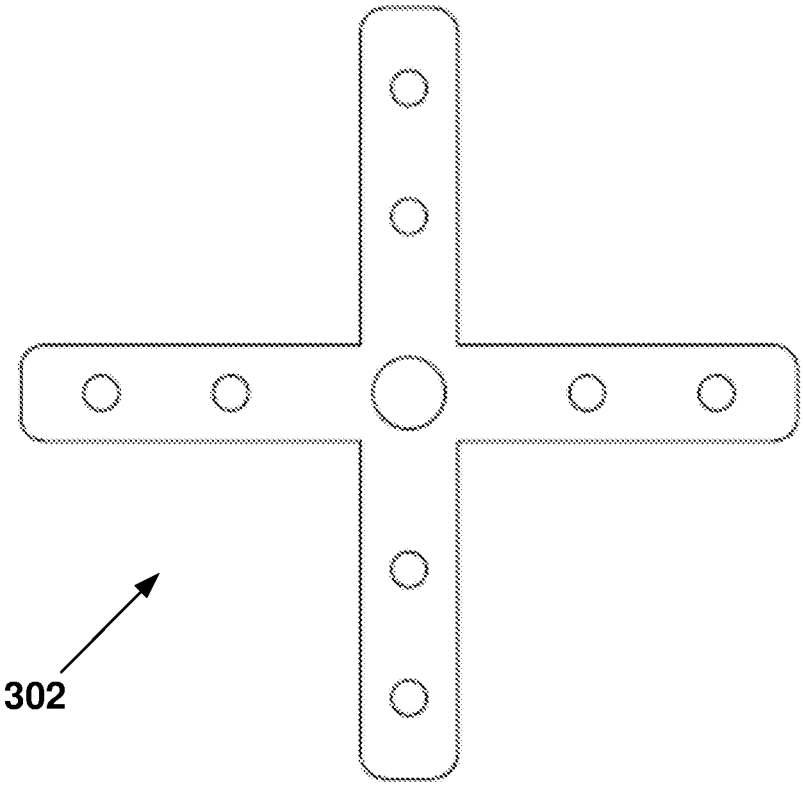
FIG. 12A is a top view of an example of the connector that is a four-way connector having two holes on each of the projections.
Figure 12B:
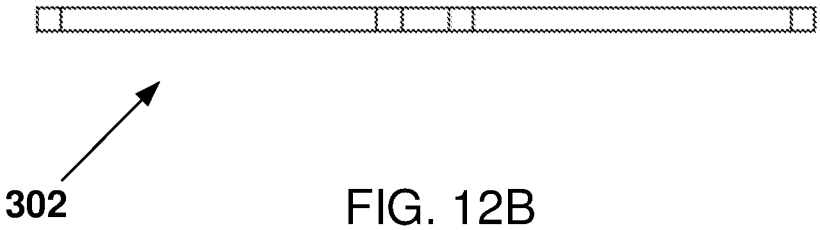
FIG. 12B is a side view of the connector illustrated in FIG. 12A.

FIG. 12A is a top view of an example of the connector 302 that is a four-way connector having two holes 308 on each of the projections 306 instead of only one hole 308 on each of the projections 306. FIG. 12B is a side view of the connector 302 illustrated in FIG. 12A.

Unless otherwise indicated, the terms "top" and "bottom" of a component refer to locations when the component is oriented as the component is configured to be installed in a drop ceiling. The term "top" refers to a location of the component that is closest to the primary ceiling, and the term "bottom" refers to a location of the component that is furthest from the primary ceiling. A vertical direction refers to the direction that is perpendicular to a plane containing the drop ceiling in which the component is configured to be installed.

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

What is claimed is:

1. A ceiling grid strut comprising:

a rail comprising a top, a bottom, and two sides, wherein the two sides are wider than the top and the bottom, wherein the top includes an upper slot, and the bottom includes a lower slot, and wherein the upper slot, the lower slot, or both is/are threaded; and a strut channel, a top of the strut channel extending along the bottom of the rail, the lower slot in the bottom of the rail opening into the top of the strut channel, a channel opening extending along a bottom of the strut channel, wherein the strut channel is integral to the rail, wherein the strut channel comprises two panel shelves, two sidewalls, and two inner ledges, wherein the panel shelves are located at the top of the strut channel, wherein each of the panel shelves extends outwards from a respective one of the two sides of the rail and substantially perpendicular to a vertical axis of the rail, wherein an upper surface of each of the panel shelves is configured to support an edge of a respective ceiling panel, wherein the sidewalls of the strut channel extend from the panel shelves and away from the bottom of the rail, wherein the inner ledges are located at the bottom of the strut channel and define the channel opening.

2. The ceiling grid strut of claim 1, wherein the ceiling grid strut is an extrusion.

3. The ceiling grid strut of claim 1, wherein the ceiling grid strut is an aluminum strut.

4. The ceiling grid strut of claim 1, wherein each of the inner ledges has a raised edge forming a hook configured to receive a strut nut having a respective groove that receives the raised edge of a respective one of the inner ledges.

5. The ceiling grid strut of claim 1, wherein the upper slot is a threaded slot, the threaded slot comprising a first set of grooves on a first side of the threaded slot and a second set of grooves on a second side of the threaded slot, the second set of grooves vertically offset from the first set of grooves.

6. The ceiling grid strut of claim 1, wherein the lower slot is a threaded slot, the threaded slot comprising a first set of grooves on a first side of the threaded slot and a second set of grooves on a second side of the threaded slot, the second set of grooves vertically offset from the first set of grooves.

7. The ceiling grid strut of claim 1, wherein the rail has a substantially rectangular cross-section.

8. The ceiling grid strut of claim 1, wherein the rail further comprises a box arch located between the upper slot and the lower slot.

9. A ceiling grid assembly comprising:

a first ceiling grid strut;

a second ceiling grid strut, wherein each of the first ceiling grid strut and the second ceiling grid strut comprises the ceiling grid strut of claim 1;

a first threaded fastener;

a second threaded fastener; and a connector comprising a first projection and a second projection, each of the first and second projections having a respective hole, wherein the first projection is coupled to the first ceiling grid strut by the first threaded fastener, which passes through the hole of the first projection of the connector and is threaded into the upper slot of the rail or the lower slot of the rail of the first ceiling grid strut, and wherein the second projection is coupled to the second ceiling grid strut by the second threaded fastener, which passes through the hole of the second projection of the connector and is threaded into the upper slot of the rail or the lower slot of the rail of the second ceiling grid strut.

10. The ceiling grid assembly of claim 9, wherein the first projection of the connector is coupled to top of the rail of the first ceiling grid strut by the first threaded fastener, which passes through the hole of the first projection of the connector and is threaded into the upper slot of the rail of the first ceiling grid strut; and wherein the second projection of the connector is coupled to the top of the rail of the second ceiling grid strut by the second threaded fastener, which passes through the hole of the second projection of the connector and is threaded into the upper slot of the rail of the second ceiling grid strut.

11. The ceiling grid assembly of claim 9, wherein the first projection of the connector is coupled to the bottom of the rail of the first ceiling grid strut by the first threaded fastener, which passes through the hole of the first projection of the connector and is threaded into the lower slot of the rail of the first ceiling grid strut; and wherein the second projection of the connector is coupled to the bottom of the rail of the second ceiling grid strut by the second threaded fastener, which passes through the hole of the second projection of the connector and is threaded into the lower slot of the rail of the second ceiling grid strut.

12. The ceiling grid assembly of claim 11, wherein tabs on the projections are slidably engaged in the lower slot of the rail.

13. The ceiling grid assembly of claim 12, wherein the tabs are located at distal ends of the projections.

14. The ceiling grid assembly of claim 9, wherein the first projection is perpendicular to the second projection of the connector, and wherein an end of the second ceiling grid strut is notched to receive the strut channel of the first ceiling grid strut.

15. The ceiling grid assembly of claim 9, wherein the connector is a two-way connector and the first and second projections are aligned along one axis.

16. The ceiling grid assembly of claim 9, wherein the connector is a three-way connector including a third projection arranged perpendicular to the first and second projections.

17. The ceiling grid assembly of claim 9, wherein the connector is a four-way connector.

18. The ceiling grid assembly of claim 9, wherein the connector has a central hole configured to receive a rod attached to a primary ceiling.

19. The ceiling grid assembly of claim 9, further comprising a strut nut, a strut washer, and a third threaded fastener, wherein the strut nut is in the strut channel and rests on the inner ledges of the strut channel of the first ceiling grid strut, and wherein the strut washer is located outside of the strut channel and is held against the inner ledges of the strut channel by the third threaded fastener, the third threaded fastener passing through the strut washer, through the channel opening, and threaded into the strut nut.

20. A ceiling grid strut comprising:

a rail comprising a top, a bottom, and two sides, wherein the two sides are wider than the top and the bottom, wherein the top includes an upper slot, and the bottom includes a lower slot, and wherein the upper slot and the lower slot are threaded; and a strut channel, a top of the strut channel extending along the bottom of the rail, the lower slot in the bottom of the rail opening into the top of the strut channel, a channel opening extending along a bottom of the strut channel, wherein the strut channel is integral to the rail, and the ceiling grid strut is an aluminum extrusion, wherein the strut channel comprises two panel shelves, two sidewalls, and two inner ledges, wherein the panel shelves are located at the top of the strut channel, wherein each of the panel shelves extends outwards from a respective one of the two sides of the rail and substantially perpendicular to a vertical axis of the rail, wherein an upper surface of each of the panel shelves is configured to support an edge of a respective ceiling panel, wherein the sidewalls of the strut channel extend from the panel shelves and away from the bottom of the rail, wherein the inner ledges are located at the bottom of the strut channel and define the channel opening.

* * * * *